US010584010B2

(12) United States Patent
Koser

(10) Patent No.: US 10,584,010 B2
(45) Date of Patent: Mar. 10, 2020

(54) AUXILIARY DEVICE FOR ALIGNING A WINDING SLEEVE AS WELL AS METHODS FOR ALIGNING A WINDING SLEEVE

(71) Applicant: Windmöller & Hölscher KG, Lengerich (DE)

(72) Inventor: Oliver Koser, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 236 days.

(21) Appl. No.: 15/458,894

(22) Filed: Mar. 14, 2017

(65) Prior Publication Data

US 2017/0267479 A1 Sep. 21, 2017

(30) Foreign Application Priority Data

Mar. 15, 2016 (DE) ..... 10 2016 104 801

(51) Int. Cl.
*B65H 19/30* (2006.01)
*B65H 19/22* (2006.01)

(52) U.S. Cl.
CPC ..... *B65H 19/305* (2013.01); *B65H 19/2215* (2013.01); *B65H 2301/41829* (2013.01); *B65H 2553/30* (2013.01); *B65H 2553/40* (2013.01)

(58) Field of Classification Search
CPC ..... B65H 19/2215; B65H 19/2223; B65H 19/305; B65H 2301/41829; B65H 2553/30; B65H 2553/40
See application file for complete search history.

(56) References Cited

U.S. PATENT DOCUMENTS

| | | | |
|---|---|---|---|
| 5,885,391 | A | 3/1999 | Cram et al. |
| 6,396,571 | B2 | 5/2002 | Ohtomo et al. |
| 6,981,333 | B2 | 1/2006 | Busch et al. |
| 2002/0024674 | A1 | 2/2002 | Albrecht et al. |
| 2013/0193254 | A1 | 8/2013 | Capriotti et al. |

FOREIGN PATENT DOCUMENTS

| | | | |
|---|---|---|---|
| DE | 60105918 | T2 | 3/2006 |
| DE | 10 2012 001 816 | A1 | 8/2013 |
| EP | 0 928 951 | A2 | 7/1999 |
| EP | 1 108 980 | A2 | 6/2001 |
| EP | 1 310 447 | A2 | 5/2003 |

(Continued)

OTHER PUBLICATIONS

Office Action dated Sep. 28, 2016 in counterpart German Patent Application No. DE 102016104801.1 (6 pgs), and English-language translation thereof (6 pgs.); 12 pages total.

(Continued)

*Primary Examiner* — William E Dondero
(74) *Attorney, Agent, or Firm* — Knobbe Martens Olson & Bear LLP

(57) ABSTRACT

Aspects of the present innovations relate to an auxiliary device for aligning a winding sleeve particularly on a sleeve acceptance of a winding machine with a reference. In one illustrative implementation, an auxiliary device may comprise an auxiliary body with an stop device or stop means which is configured for contact with the counter stop device or counter stop means at the winding sleeve. According to further aspects, the present innovations may comprise a method for aligning a winding sleeve with a reference.

20 Claims, 4 Drawing Sheets

(56) References Cited

FOREIGN PATENT DOCUMENTS

| | | |
|---|---|---|
| WO | WO 01/42736 A1 | 6/2001 |
| WO | WO 2007/096916 A1 | 8/2007 |

OTHER PUBLICATIONS

Bosch glm 250 vf manual-221954 dated Dec. 21, 2015; 15 pages.
English language translation of Extended European Search Report dated Jun. 26, 2017, issued in related European Patent Application No. 17153194.0; 5 pages.
Extended European Search Report dated Jun. 26, 2017 for European Patent Application No. 17153194.0; 9 pages.
German Office Action dated Jul. 15, 2019 in related German patent application No. 102016104801.1, 5 pp.

AUXILIARY DEVICE FOR ALIGNING A WINDING SLEEVE AS WELL AS METHODS FOR ALIGNING A WINDING SLEEVE

CROSS-REFERENCE TO RELATED APPLICATION(S)

This application claims benefit/priority to German patent application No. 10 2016 104 801.1, filed Mar. 15, 2016, published as DE 10 2016 104801 A1 (and attached hereto as an Appendix), which are incorporated herein, either by reference or directly, in entirety.

BACKGROUND

Field

Aspects of the present innovations relate to an auxiliary device for aligning a winding sleeve and a method for aligning a winding sleeve.

Description of Related Information

In production methods in which the product is winded up to a sleeve since it is, for example, a product with a wide, but flat extension, such sleeves are regularly exchanged. Such an exchange can, for example, occur, because a sleeve which is previously wounded with a certain amount of the product or also if a winding only partly produced comprising the product and the sleeve, is sorted out as waste. This can for example be intended due to a tearing off of the product. An exemplary product process is the film production with which a sleeve is wound up with a film until a predetermined product extend exists. For the exchange a second winding sleeve is placed on a separate sleeve acceptance such that this automatically or manually for example by rotation of a machine part which comprises the prepared and the acceptance in use is exchangeable. Since, however, in such a winder machine different widths of the products are produced a winder excess is often configured wider than a receiving sleeve, such that for the exchange between the receiving sleeve and the sleeve in production both sleeves have to be aligned to one another such that the subsequent product is arranged defined on the sleeve.

Thus, it can for example be necessary that the winding up of the product to the sleeve occurs central, such that at the edges of the winder part of the sleeve extends respectively and the winder can be accepted in a subsequent process step. In order to be able to perform such an alignment often the ends of the old sleeve are marked during removal of the previous sleeve from the sleeve acceptance, which is for example possible by manual insertion of a notch on the sleeve acceptance. This manual process, however, is complex since every time a new marking is necessary, which as far as they are not removed, additionally, promotes confusion since the assignment of the last "correct" notch becomes more difficult with an increasing amount. Further, the user has to climb into the machine in order to define a reference point. However, this is cumbersome since in such product machines often only little space is available.

Further, fixed devices are known which are arranged at a fixed position in the winder machine such that per device a certain alignment of a winding sleeves can drive up to. Such devices are inflexible particularly, concerning different product sizes and different winding sleeves. Thus, each fixed device is often only applicable for a single size of winding sleeves at the machine since the fixed position is not alterable.

It is an advantage of innovations herein to at least partially avoid the previously described disadvantages from the state of the art. Particularly it is an advantage of innovation herein to simplify an alignment of a winding sleeve and thereby to ensure the alignment of the winding sleeve with low costs in a safe and flexible manner.

Such advantages may be achieved or disadvantages solved via a device with the features of claim 1 and a method with the features of claim 15.

Further, features and details of the innovations result from the dependent claims, the description and the drawings. Thereby, features and details which have been described in relation to a device according to the inventions herein, naturally also apply in connection with the methods according to the innovations herein and vice versa, such that according to the disclosure of the single aspects of the inventions it can always be reciprocally related to.

DETAILED DESCRIPTION OF ILLUSTRATIVE IMPLEMENTATIONS

Figure 1:
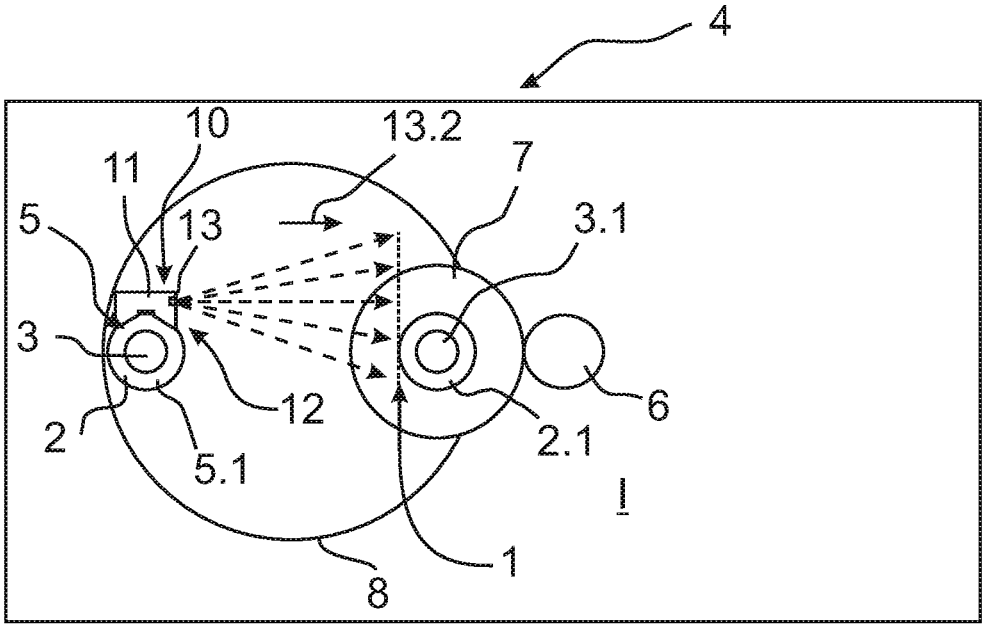
FIG. 1 illustrates an alignment device according to the innovations herein for aligning a winding sleeve in a winder machine in a schematic lateral view of the winder machine, according to one or more implementations.

According to aspects consistent with one or more innovations herein, an auxiliary device for alignment of a winding sleeve with a reference may comprise an auxiliary body with a stop device or structure (also referred to as a stop means herein), which is configured for contact at counter stop device or means of the winding sleeves. Further, the auxiliary device may comprise an alignment device or means which is suitable for alignment of a winding sleeve with the reference. The stop means and the alignment means may further comprise a certain relationship to one another, particularly the auxiliary device can be suitable for alignment of a winding sleeve on a sleeve acceptance of a winder machine. Preferably, a winder machine for film production is involved with the winder machine.

Therewith, preferably a sleeve is involved with the winder machine on which a film can be wound up, such that a transport and/or a resale is possible. Further, via the winding sleeve a sleeve can be understood which is only suitable for an acceptance of a product winder or a sleeve forming the basis for a product winder with other sleeves. By a stop means or a counter stop means, preferably, a flat configuration of the auxiliary body or the winding sleeve can be understood. Thus, as the stop means for example a landing in form of the auxiliary body or a landing at the auxiliary body can be provided which can be brought into contact with the front face of the winding sleeve and then can act therewith. Further, additional forms of counter stop means and stop means are possible, like for example a round shape, wherein preferably the stop means and the counter stop means can be configured corresponding to one another, particularly the form of the stop means can correlate with a negative form of the counter stop means. Further, the stop means can comprise an additional component, which is directly or indirectly arranged at a resting section of the auxiliary body. By an alignment device or means within the sense of the present invention preferably, an auxiliary mean can be understood, in order to determine the position of the auxiliary device and therewith, particularly the winding sleeve relative to the reference in relation to at least one direction. Therewith, the alignment device or means (generally referred to herein as just "alignment means" for the sake of simplicity, as are other such devices or structures) can for example be a location means with which the user can target the reference. Thereby, the user can for example obtain information about the current positioning of the auxiliary device or the winding sleeve relative to the reference. Thereby, however, further forms of alignments means are possible like for example a rod, particularly a telescopic rod which reaches from the auxiliary device into the winding machine and therewith in the vicinity of the reference or can be brought in contact with the reference. Particularly, aligning the winding sleeve with the reference thus can include to adjust the winding sleeve relatively to, particularly in relation to, the reference. The reference can thereby be a certain point, a certain position or a certain area, preferably the reference can be the edge of the second winding sleeve, particularly situated in the production process or position in a certain distance to the end of the second winding sleeve. Therewith, the alignment of the winding sleeve can comprise a dislocation of the winding sleeve, particularly together with the auxiliary device until the reference can be targeted by the alignment means. Therewith, it is important for the alignment of the winding sleeve that the relation can be determined between the stop means and alignment means. By such a relation, for example, a dimensional relation can be understood, which is particularly measurable. Moreover, further determined relations are possible, for example the determination of the relation can occur by reading of a scale, which is preferably assembled in the auxiliary body or the relation can be determined electronically. Here, however, further possibilities to determine the relation are possible. By an auxiliary body, preferably a main body of the auxiliary device can be understood, which particularly mainly determines the form of the auxiliary device. Thus, the auxiliary body can for example comprise a one part or multiple part housing which protects parts of the auxiliary device from environmental influences. Within the winding machine the winding sleeve can further be assembled on the sleeve acceptance against displacement. Thus, for example a clamping device in the winding sleeve or in the sleeve acceptance can be provided in order to ensure the arrangement, particularly after successful alignment of the winding sleeve and therewith to ensure for the further production process and the aligned position on the sleeve acceptance.

An auxiliary device according to the invention is thereby easy to handle and applicable for different winding sleeves and therewith different references, such that a flexible use in the production process particularly of films can be enabled. Thereby, the auxiliary device enables particularly an alignment of the winding sleeve during operation, such that for example the completion of a winder in operation of a second winding sleeve can be in process while the alignment of the winding sleeve occurs. Therewith, the production time of the production process can be reduced. Therewith, that the alignment of the winding sleeve can occur preferably in a distance to the reference, the safety of the winder machine can be increased.

Within the scope of the present inventions it can preferably be provided that the alignment means is an optic and/or acoustic alignment means. By an optic alignment means, for example an illumination means can be understood which emits light such that the position of the alignment means can be adjusted with the reference. However, it is further possible that the optic alignment means is a focusing element. The focusing element can for example be a lens through which a user can look through in order to be able to displace the winding sleeve until it targets the reference or is visible in a certain area of the lens. By an acoustic alignment means further, it can be understood that a signal tone sounds as soon as the alignment means has reached a certain position in relation to the reference. Thus, for example an optic alignment means with an acoustic alignment means can be combined such that a light scanner emits a signal with reaching the reference to an electronic of the auxiliary device or the alignment means and the alignment means subsequently generates a signal tone. Optic and/or acoustic alignment means particularly comprise the advantage that these can operate without contact. Thereby, a high range of the alignment means can be achieved, such that the alignment of the winding sleeve can take pace in distance to the production process. Thereby, the safety, the comfort and flexibility during alignment of the winding sleeve can be increased.

It is further advantageous that the alignment means with an auxiliary device according to the invention comprises a light output means wherein the light output means particularly comprises a laser. Thereby, the positioning of the alignment means and therewith the contact means or the winding sleeve can be demonstrated for the user by the light output means. A laser can thereby, preferably, comprise a high intensity of light output, such that during different light conditions a visible and reliable alignment aid can be ensured. Particularly by a strict distinction of the laser or the area irradiated by the laser. Further, a high accuracy during alignment can be achieved. Preferably the laser can be a cross or point laser, preferably the laser emits a linear area such that an exact positioning of the auxiliary device particularly on the extend of the winding sleeve is not necessary, so that an alignment can be further simplified when the contact means is in contact with a counter stop means.

Advantageously, it can by provided with the auxiliary device according to the invention that the stop means can contact the counter stop means at least mainly in one contact plane and the alignment means is assembled such that the alignment means and the reference are located mainly in a parallel or identical plane with the stop plane when the winding sleeve is aligned. Particularly, the alignment means and the reference can be completely in a parallel or identical plane with the stop plane when the winding sleeve is aligned. Thereby, preferably a targeting of the reference in the plane can occur such that relation between the alignment means and the contact means is particularly simply determinable and therewith the alignment is overall simplified.

Within the scope of the invention the auxiliary device can be used for alignment of the winding sleeve preferably mobile. Thereby, particularly a safety element can be provided, through which the auxiliary body is visible at the winder machine. By a mobile usability it can by understood that the auxiliary device is portable or transportable, therewith particularly separable from the winder machine or usable independent from the winder machine. Therewith, preferably the auxiliary device can be a handheld unit. Thereby the auxiliary device is flexibly usable and can comprise a particularly easy handling for example with the use in different machines. Further, a possible exchange of the auxiliary device can thereby be enabled particularly simple. By the safety element the auxiliary device can be arranged at the winder machine or can be connected to the winder machine. Thus, for example as a safety element a key ring or a simple through bore can be provided. Thereby, the auxiliary device can be arranged, particularly detachably by an additional safety means, for example a rope, a wire or such like at the winder machine, such that a safety against falling down or getting lost can be ensured with a simultaneous obtainment of flexibility.

An auxiliary device according to the invention can further preferably comprise a channel element which is suitable for the acceptance of a winding sleeve. Such a channel element can be open at one side and therewith, for example, configured by a recess at the auxiliary body from this extending bridges additional walls or such like. Thereby, placing of the auxiliary device on the winding sleeve and therewith, a particularly simple contacting of the stop means and the counter stop means can be ensured. Further, it is thereby enabled that with a correct placing of the auxiliary device in relation to the winding sleeve comprises only one rotating degree of freedom when the channel element is contacting the winding sleeve and the stop is contacting the counter stop at the winding sleeve. The therewith enabled simple relation of the auxiliary device or the winding sleeve to the reference can further simplify the alignment of the winding sleeve.

Preferably, the channel element can comprise a channel axis with an auxiliary device according to the invention and the stop means and/or alignment means can be adjustable parallel to the channel axis. By the channel axis an extension axis of the channel element can be understood which preferably is aligned parallel to the cylinder axis or sleeve axis of the winding sleeve when the auxiliary device on the winding sleeve is positioned for a alignment of the winding sleeve. By adjustability thereby can be understood that the stop means and/or the alignment means for example are loosely displaceable or are displaceable by a drive. Such a drive can for example be a spindle drive which can be actuated by hand or an energy unit with the loose displaceability, it can be for example provided that the alignment means and/or the stop means remains in position by friction in relation to the auxiliary body, particularly that for a further displacement the friction has to overcome. By adjustability the relation between the stop means and the alignment means can be altered, such that according to the relation of the winding sleeve is alterable to the reference. Thus, it is for example possible that a subsequent sleeve is particularly shorter than a second winding sleeve, particularly in the production process, and the user knows the target-distance of the front side of the subsequent sleeve to the reference, particularly to the front side of the second winding sleeve on a second sleeve acceptance of the winder machine. Particularly, the user can thereby adjust the alignment means and the stop means to one another such that further in a simple process the relation between the position of the alignment means and the reference remains. This, however, leads to an altered relation between the winding sleeve and the reference in order to ensure the adjustability. Further, preferably the auxiliary body can be configured from two parts, wherein particularly the first and second body parts of the auxiliary body can be displaceable to one another.

With an auxiliary device according to the invention it can further be preferably provided that the auxiliary body comprises a handle means, particularly wherein the handle means comprises a recess in the auxiliary body. Preferably can be provided that the auxiliary comprises two recesses which are assembled at opposing sides of the auxiliary body by handle means. However, under a handle means also a hand grip or an elevation can be understood. A recess can for example be a rounded groove which can preferably adjusted to the form of a part of the hand or finger for engaging. Thereby, the ergonomics with the using of the auxiliary device and the secure handling of the auxiliary device can further be increased, such that the risk of falling down of the auxiliary device is reduced and therewith a robust use is increased. Two recesses at opposing sides of the auxiliary body further comprise the advantage that the auxiliary device is thereby ergonomically encompassable while simultaneously a support for thumb and fingers is existent.

It is further possible that an auxiliary device according to the invention comprises an energy unit in order to operate the alignment means particularly wherein the energy unit is a battery. Alternatively, an energy unit however a solar or a photovoltaic cell or other energy source can be understood. Thereby, energy can be provided which for example is usable for the operation of a laser or for one or multiple further automatization functions of the auxiliary device. By the use of the energy unit thereby further the mobility and therewith the flexibility of the auxiliary device can be further increased since for example no energy connection like a cable or wire or such like is necessary. Preferably, the battery can be a lithium-ion-battery in order to ensure a high reliability and durability of the battery.

Preferably, the auxiliary body with an auxiliary device according to the invention can comprise at least one contact area which can be brought in contact with the winding sleeve. Additionally or alternatively, the contact area can be brought into contact with a sleeve acceptance, for example when a contact area of the stop element is configured by a front surface of the auxiliary body. Preferably the contact area can be structured. By the structure at the contact area an increase friction value can be achieved. Thereby, a contacting of the auxiliary device on the winding sleeve can be simplified, particularly wherein the contact area can simultaneously ensure a safety against falling down. Likewise, for example when the winding sleeve is a sleeve from paper a penetration of the structure of the contact area can be provided such that support of the auxiliary device on the winding sleeve is promoted.

Within the scope of the invention the auxiliary body can comprise at least a second contact area which is assembled in an angle to the first contact area, particularly the angle can be smaller or equal 150°, preferably smaller or equal 135°. Thereby, the contact areas can generate a prismatic form such that different cross sections of winding sleeves can be taken into account, preferably it can further be provided that the contact areas are separated by a recess which particularly precedes in the center of the auxiliary body. Thereby, it can be an advantage in order to accept winding sleeves with different radii by the contact area since smaller radii are assembled deeper in the auxiliary body. Further, the notch effect at this position at which the contact area hit one another can be reduced and particularly impossible production-caused impure edge between the contact areas can be avoided. Thereby, however, it is particularly possible that both contact areas are realized by a curved single area element by the assembly of the contact areas. Therewith, for example the flexibility of the auxiliary device can be increased in relation to the winding sleeves with different diameters and at the same time the support of the auxiliary device to the winding sleeve can be increased.

It is further possible that the auxiliary device according to the invention the stop means comprises a blade which comprises particularly a thickness of smaller or equal 1 mm preferably smaller or equal 0.6 mm. Thereby, the blade can be configured particularly thin and preferably comprise a sharpened edge area. Further, the stop means can for example be provided as a metal sheet element for example from stainless steel. This provides the advantage that the stop means is thereby particularly robust according to strains and unfavorable environmental conditions within a production.

Within the scope of the invention it can be provided that the auxiliary device comprises a switch element by which the alignment means is transferable from an activated state to a deactivated state, wherein the alignment of the winding sleeve with the reference is possible via the auxiliary device, when the alignment means is in the activated state, and wherein the alignment of the winding sleeve with the reference is impossible by the auxiliary device when the alignment means is in the deactivated state. Thereby, the switch element can be particularly advantagously be arranged opposing a locating direction of the alignment means at the auxiliary body. By the switch element for example a component or assembly can be understood which preferably is usable by a user and electrically or manually accessible. Thereby, the switch element can comprise a button which can be pushed by the user in order to switch between the activated state and the deactivated state. The switch element can, however, be signal driven such that this enables a change of state via the software. Further, it can be provided that the alignment means in a deactivated state is protected or switched off and in an activated state is in an operational position or switched on. By the location direction for example a target direction of the alignment means can be understood which can be aimed by the reference or by the target direction the effective direction of the alignment means can be understood in which particularly the alignment means and the reference are assembled to one another. By the switch element the advantage results that the alignment means is protectable or energy can be saved by an intermediate deactivated state. Thereby, an increased robustness of the auxiliary device results. Additionally, it can be an advantage that the safety of the auxiliary device is increased by an intension of the deactivated state of the alignment means when, for example, the alignment means is a laser which can by looking into the laser effect the eye sight of the user. By an assembly of the switch element in relation to the location direction the alignment means can further increase the ergonomics such that it is for example actuatable by a thumb. Thereby, the adjustment can by further simplified.

Within the scope of the invention it can further be provided that the auxiliary body is configured from plastics. Such a plastic can for example comprise polyethylene, polypropylene or polyvinylchloride. Particularly, the plastic can preferably be polyamide. Further, the plastic can particularly be glass- or carbon-fiber reinforced. Thereby, the auxiliary body can preferably be a cast part or a milled part. Therewith, the auxiliary body is cost efficiently producible and simultaneously a robustness concerning falling down or other extreme situations of the auxiliary device. Further, the auxiliary body can preferably be configured in one piece with the stop means, particularly such that the stop means is likewise configured from plastic. The auxiliary body and the stop means, however, can be configured from multiple parts, wherein the stop means preferably comprises a metal or plastic and particularly the auxiliary body is configured from rigid plastic.

According to a further aspect of the invention a method for aligning of a winding sleeve with a reference is claimed. Thereby, a method comprises the following steps:

- Placing of an auxiliary device at the winding sleeve such that a stop means of the auxiliary device can be brought into contact with a counter stop means at the winding sleeve
- Combined displacement of the auxiliary device and the winding sleeve until an alignment of the winding sleeve occurs with the reference via an alignment means of the auxiliary device.

Thereby, by a combined displacement it can be understood that the auxiliary device is for example placed on the winding sleeve or is fixed on the winding sleeve, wherein the displacement can be realized by sliding of the auxiliary device and/or the winding sleeve.

Preferably, further a preparation step can be provided, wherein the winding sleeve is put on a sleeve acceptance of a winding machine. Therefore the method comprises a particularly simple, flexible and safe possibility to perform the alignment of the winding sleeve. Further, a follow-up step can be provided within which the winding sleeve is fixed by a clamping device of the winding sleeve or the sleeve acceptance in its position on the sleeve acceptance. Preferably, the auxiliary device can be configured according to claims 1 to 14. Therewith, the method according to invention provides the same advantages like they are described in detail in relation to the device according to the invention.

Within the scope of the invention it can further be provided that the method additionally comprises the following particularly preparing step:

- Transfer of the alignment means from the deactivated state into an activated state.

Preferably, the transfer of the alignment means can occur previous to the adjustment of the winding sleeve at the reference. By the intention of the different states energy savings can occur. Further, the safety of the method for adjustment of the winding sleeve can be increased when the active state of the alignment means provides a risk of injury like for example the direct looking into a laser source by the user.

The steps of a method according to the invention can preferably occur in the given order or in another order. Particularly, the single steps or all steps of the method can be repeatable or be repeated.

Further, measures improving the invention result from the subsequent description to some embodiments of the invention, which are shown schematically in the figures. All features and/or advantages from the claims, the description or the drawings including constructive details, spacial arrangement and method steps can be essential for the invention, each single by themselves or in any combination. Thereby it is to be considered that the figures only have descriptive character and are not provided to restrict the invention in any form. Various aspects are shown in the following drawings.

FIG. 1 illustrates an alignment device according to the innovations herein for aligning a winding sleeve in a winder machine in a schematic lateral view of the winder machine, according to one or more implementations.

Figure 2:
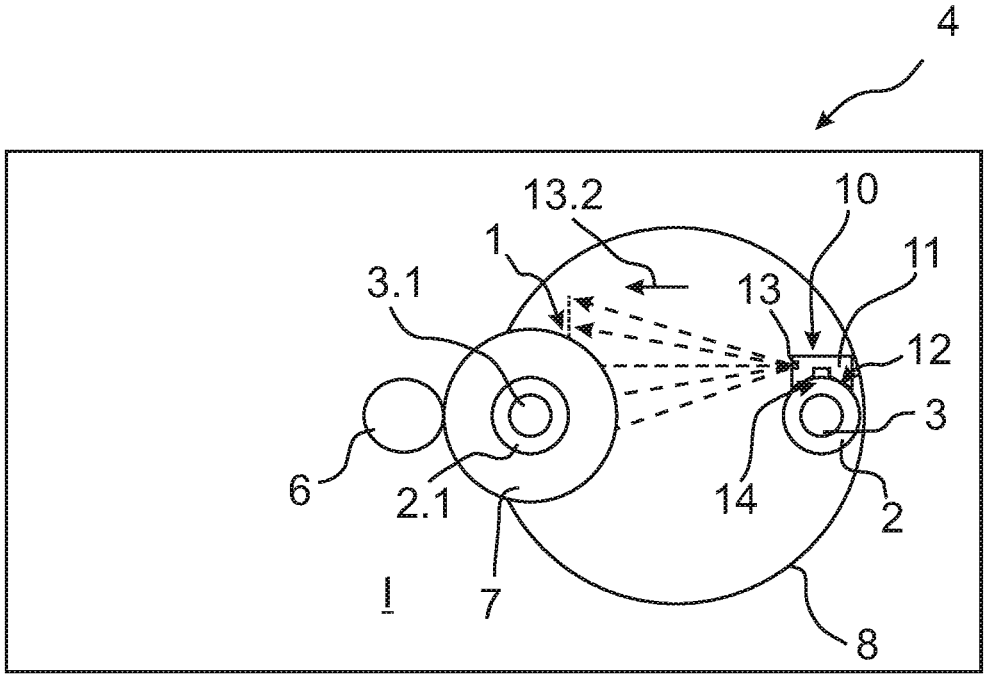
FIG. 2 illustrates the auxiliary device according to innovations herein for aligning the winding sleeve in the winder machine according to a first embodiment in a schematic lateral view of the winder machine from the opposing side, according to one or more implementations.

FIG. 2 illustrates the auxiliary device according to innovations herein for aligning the winding sleeve in the winder machine according to a first embodiment in a schematic lateral view of the winder machine from the opposing side, according to one or more implementations.

Figure 3:
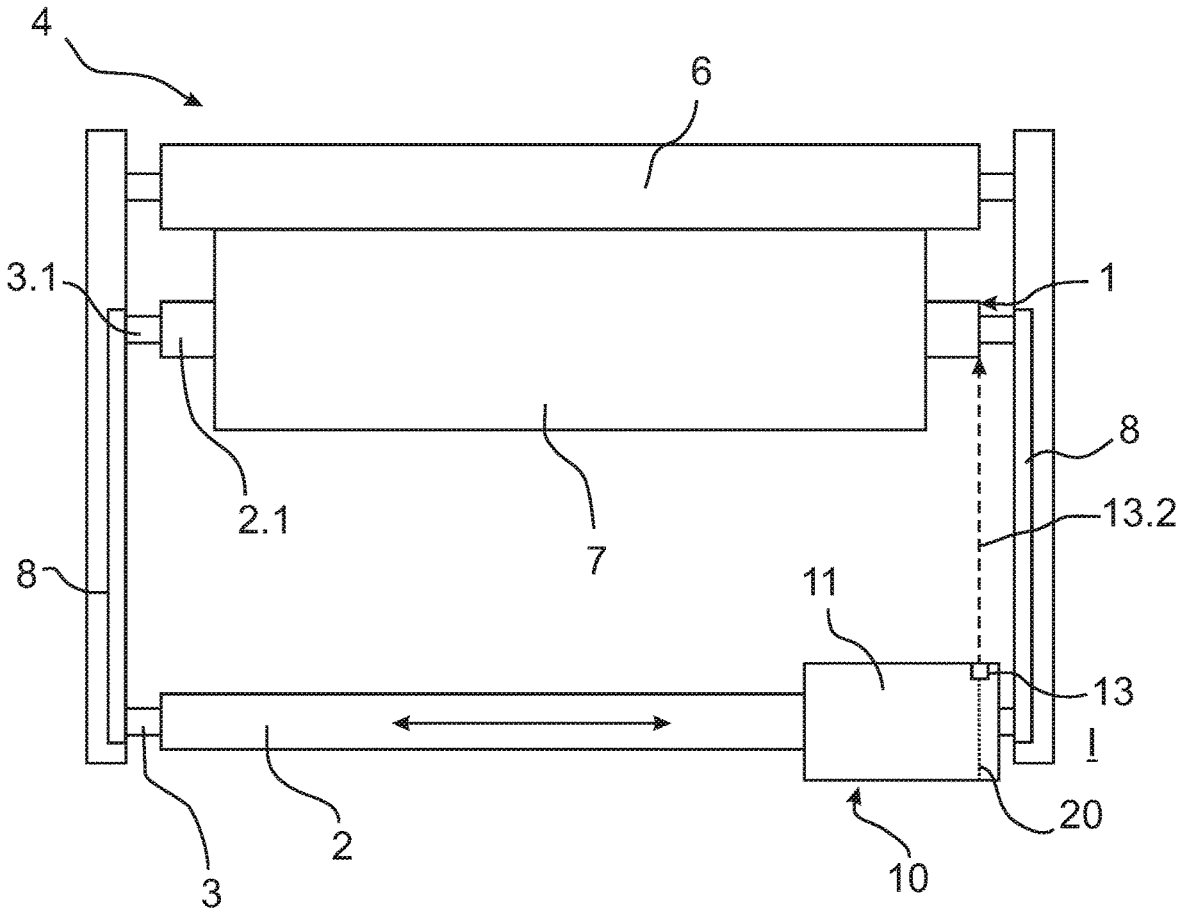
FIG. 3 illustrates the auxiliary device according to innovations herein for aligning the winding sleeve in the winder machine in a schematic top view of the winder machine, according to one or more implementations.

FIG. 3 illustrates the auxiliary device according to innovations herein for aligning the winding sleeve in the winder machine in a schematic top view of the winder machine, according to one or more implementations.

Figure 4:
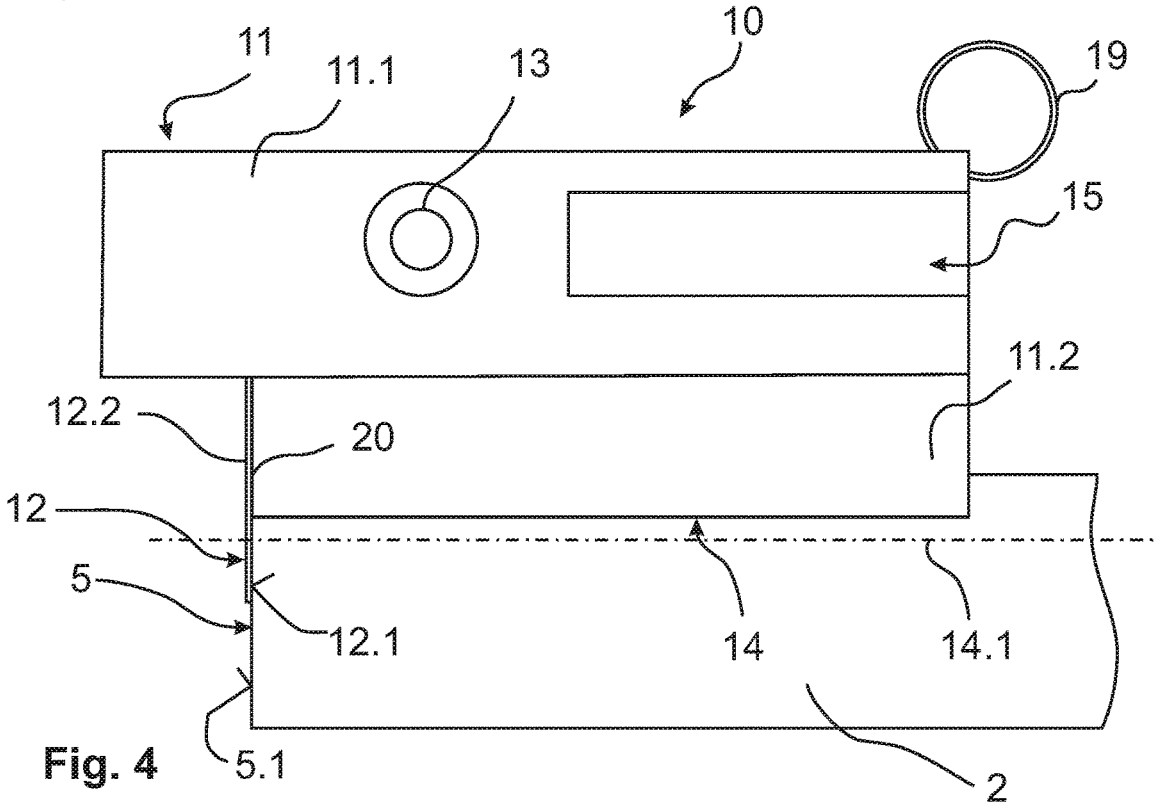
FIG. 4 illustrates an auxiliary device according to the innovations herein on a winding sleeve in a schematic lateral view, according to one or more implementations.

FIG. 4 illustrates an auxiliary device according to the innovations herein on a winding sleeve in a schematic lateral view, according to one or more implementations.

Figure 5:
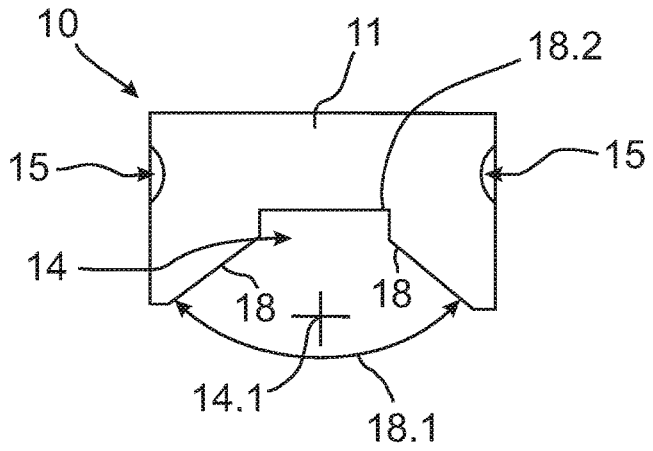
FIG. 5 illustrates an auxiliary device according to the innovations herein in a schematic frontal view, according to one or more implementations.

FIG. 5 illustrates an auxiliary device according to the innovations herein in a schematic frontal view, according to one or more implementations.

Figure 6:
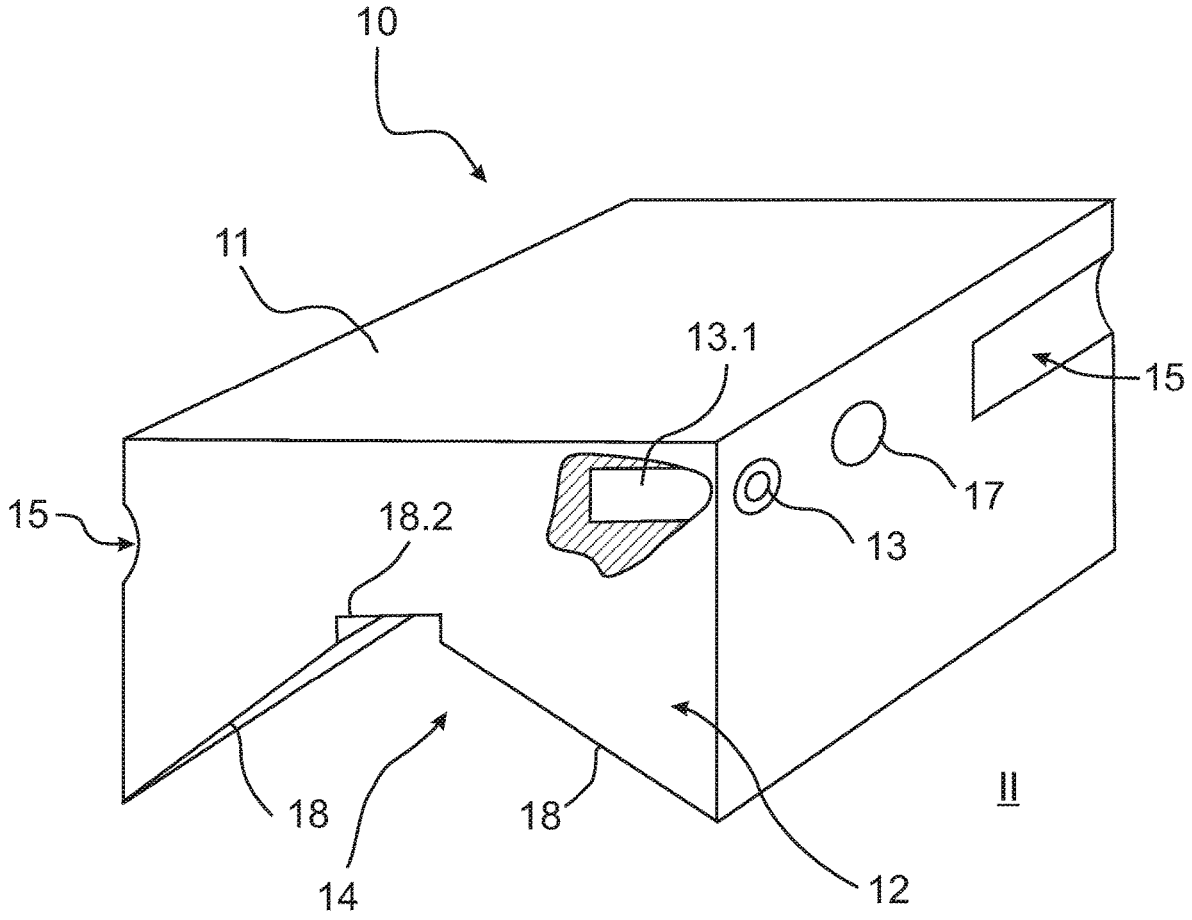
FIG. 6 illustrates an auxiliary device according to the innovations herein in a schematic perspective view, according to one or more implementations.

FIG. 6 illustrates an auxiliary device according to the innovations herein in a schematic perspective view, according to one or more implementations.

Figure 7:
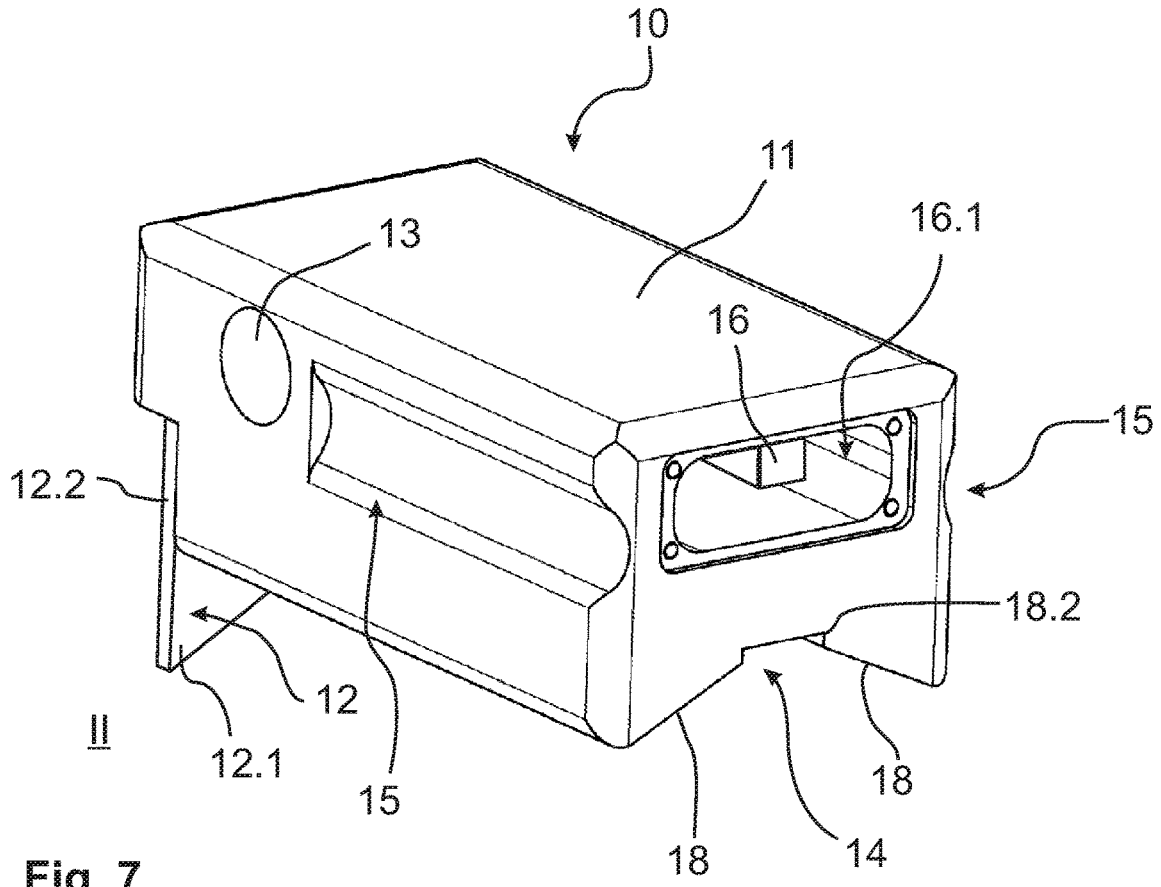
FIG. 7 illustrates an auxiliary device according to the innovations herein in a schematic perspective view, according to one or more implementations.

FIG. 7 illustrates an auxiliary device according to the innovations herein in a schematic perspective view, according to one or more implementations.

Figure 8:
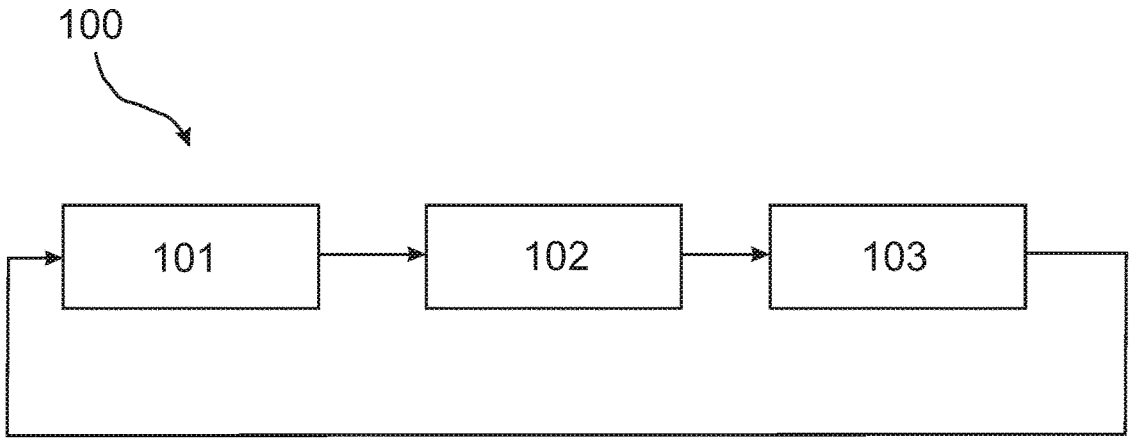
FIG. 8 illustrates a method according to the innovations herein for aligning a winding sleeve, via a schematic drawing, according to one or more implementations.

FIG. 8 illustrates a method according to the innovations herein for aligning a winding sleeve, via a schematic drawing, according to one or more implementations.

In the subsequent figures for the same technical features the identical reference signs even from different embodiments are used.

FIG. 1 shows an auxiliary device according to the invention in the schematic lateral view of a winder machine 4 for adjustment of a winding sleeve 2 on a sleeve acceptance 3 of the winder machine 4 to a reference 1 in a first embodiment. Thereby, the auxiliary device 10 is assembled on the winding sleeve 2 such that the stop means 12 of an auxiliary body 11 of the auxiliary device 10 is brought into contact with counter stop means 4 of the winding sleeve 2, wherein particularly a stop area 12.1 of the stop means 12 and the counter stop area 5.1 of the counter stop means 5 act together. The counter stop means 5 can preferably be the front side of the winding sleeve 2. The stop means 12 can further comprise a blade 12.2 which extends in direction to the cylinder axis of the winding sleeve 2 from the auxiliary body 11. For adjustment of the winding sleeve 2 at the reference 1 the auxiliary device 10 further comprises an alignment means 13, wherein the alignment means 13 and the stop means 12 comprise a certain relation to one another. Thereby, the stop means 12 can be brought into contact at counter stop means 5, at least mainly or completely in a stop plane 20.

Further, it can be preferably provided that the alignment means 13 is arranged such that the alignment means 13 and the reference 1 are mainly in a parallel or identical plane with the stop plane 20. Thereby, results a direction connection between the axial positioning of the counter stop means 5 which preferably can be a frontal side of the winding sleeve 2 and the reference 1. Reference 1 can particularly be the counter stop means 5 and the corresponding and to the counter stop means 5 in a second particularly within the winder process winding sleeve 2.1 on an assigned second sleeve acceptance 3.1. The second winding sleeve 2.1 can for example be wound up or can be wound up by a product wrap 7 which is particularly film wrap which is pressed by the contact roller 6 of the winder machine 4 in order to produce a particularly compact product wrap 7 and/or to avoid air inclusions. The winding sleeve 2 is alignable by the auxiliary device 10 with the reference 1 the alignment means 13 is in active state I such that this acts in a location direction 13.2 and a user can estimate or determine the relative position of the winding sleeve 2 to the winding sleeve 1 or the second winding sleeve 2.1. Preferably, the alignment means 13 can be an optical alignment means which the user can target the reference 1 in location direction 13.2 or which emits in location direction 13.2 so that for example a light markings results. Is the winder process of the product wrap 7 about the second winding sleeve 2.1 completed and the winding sleeve is intentionally aligned the auxiliary device 10 which is particularly mobile can be removed from the winding sleeve 2 such that the second winding sleeve 2.1 and the winding sleeve 2 can be switched in their position by a rotating device 8 of the winder machine 4. Thereby, the second winding sleeve 2.1 can be removed with a completed product wrap and the new winding sleeve 2 can be wrapped up. Preferably, the winding sleeve 2 can be fixed by a clamping device of the winding sleeve and/or the sleeve acceptance 3 in an aligned position such that the winding sleeve 2 does not shift on the sleeve acceptance 3 during the winding process in the winding machine 4.

FIG. 2 shows an auxiliary device 10 according to the invention according to a first embodiment in a schematic lateral view of the winder machine 4 in the winder machine 4 with a view from the side which is opposing to the view in FIG. 1. Thereby, it is shown that the auxiliary device 10 is assembled with a channel element 14 of auxiliary body 11 which is open downwards on the winding sleeve 2 such that in connection with in FIG. 1 shown stop means 12 which is brought in contact with the counter stop means 5 and the auxiliary device 10 only one rotating degree of freedom remains on the winding sleeve 2. Preferably, therewith with the alignment means 13 it can be a linear laser such that the rotating positioning of the auxiliary device 10 on the winding sleeve 2 allows great tolerances without a loss of accuracy. This simplifies the alignment of the winding sleeve 2 by reference 1.

FIG. 3 shows an auxiliary device 10 according to the invention for aligning the winding sleeve 2 on a sleeve acceptance 3 of the winding machine 4 according to the first embodiment in a top view. Thereby, it can be seen that the alignment of the winding sleeve 2 via an auxiliary device 10 occurs axial until the alignment means 13 is aligned with the reference 1. Thereby, it can by ensured that a connection between the positioning of the winding sleeve 2 and a second winding sleeve 2.1 is ensured. Thereby, it is particularly preferred when the alignment means 13 is assembled such that the alignment means 13 and the reference 1 are at least mainly at an identical plane with the stop plane 20 when the winding sleeve is aligned. Thereby, the stop means 12 preferably comprises a stop area 12.1 and a counter stop means 5 preferably the counter stop area 5.1. Hereby, however, also further embodiments are possible like for example a parallel plane.

The auxiliary device 10 of the first embodiment can additionally or alternatively particularly according to FIGS. 5 and 6 preferably configured according to the auxiliary device of the embodiment of FIG. 4 or 7.

FIG. 4 shows an auxiliary device 10 according to the invention in a schematic lateral view in a further embodiment. Thereby, the auxiliary device 10 comprises an auxiliary body 11 with a first body part 11.1 and a second body part 11.2. Further, a stop means 12 which comprises a blade 12.2 is arranged at the second body part 11.2 of the auxiliary body 11. At the first body part 11.1 of the auxiliary body 11 further an alignment means 13 is arranged which is suitable for aligning the winding sleeve 2 with a reference 1 like for example shown in the first embodiment. Thereby, the stop means 12 and the alignment means 13 comprise a certain relation to one another, wherein the certain relation in the present embodiment can for example be the distance from the center of the alignment means 13 to a stop plane 20 of the stop means 12 at the counter stop means 5 of the winding sleeve 2. Preferably, the auxiliary device 10 can be configured such that the stop means 12 is adjustable to the alignment means 13. Thereby, an alternated relation between the stop means 12 and the alignment means 13 can be generated. Preferably, thereby for example the first and the second body parts 11.1, 11.2 can be adjustable to one another, wherein this adjustment can be performed particularly along a channel axis 14.1 of an channel element 14 open at one side. Further, the stop element 12 comprises a blade 12.2 such that the blade 12.2 can be insertable between two winding sleeves 2 for example in order to separate these or to adjust a single winding sleeves. Additionally, at the auxiliary body 11 a handle mean 15 is provided. The handle mean 15 can preferably be a groove which is introduced into the auxiliary body 11. Further, at the auxiliary body 11 a safety element 19 is provided. Particularly, the safety element 19 is a key ring which is connectable in a flexible safety means of a winder machine 4 in order to protect the auxiliary device 10 against falling down. The flexible safety means of the winder machine 4 can for example be a rope, a wire or such like.

FIG. 5 shows an auxiliary device 10 according to the invention in a schematic frontal view of the auxiliary device 10 in a further embodiment. Thereby, the auxiliary device 10 comprises an auxiliary body 11, wherein at two opposing sides of the auxiliary body 11 a handle means 15 is arranged respectively. Thereby, the handle means 15 is preferably configured as a groove. Thereby, a user of the auxiliary device 10 can encompass the handle means 15 and thereby engage into the handle means 15. Further, the auxiliary device 10 comprises a channel element 14 which is particularly configured by two parts of the auxiliary body 11 extending downwards. Thereby, a channel axis 14.1 proceeds along the main extension direction of the auxiliary body 11, particularly perpendicular to the drawing plane. Further, at the auxiliary body 11 a first and a second contact area 18 are configured, which are adjusted in an angle 18.1 to one another. Preferably, the angle 18.1 is smaller or equal 150°, particularly preferred smaller or equal 135°. Thereby, the contact area 18 is configured to be brought in contact with a winding sleeve 2. In order to ensure an increased support according to this it can be further provided that the contact area 18 is structured. Thus, for example a knurling of the contact areas 18 or a pimple-like structure can be provided in order to increase the friction value. Between the contact areas 18 further a groove 18.2 is provided such that notch effect is reduced in this position and different diameters of winding sleeves 2 can be particularly considered.

FIG. 6 shows an auxiliary device 10 according to the invention with an auxiliary body 11 which comprises a handle means 15 at two opposing side respectively. Thereby, further a channel element 14 is configured which is open at the lower side. Further, at the lower side of the auxiliary body 11 contact areas 18 are configured, such that the auxiliary device 10 is placeable with the contact areas 18 on the winding sleeve 2. By an angle 18.1 between the contact areas 18 and a groove 18.2 which proceeds central between the contact areas 18 different diameters of different winding sleeves 2 are preferably considerable. Thereby, the auxiliary device 10 can alternatively be placed by contact areas 18 on a sleeve acceptance 3 such that a frontal side of the auxiliary body 11 can serve as a stop means 12. Additionally or alternatively the stop means 12 can be provided as an additional component which is assembled in a section of the auxiliary body 11. Further, like it can be partly recognized in the fractional view in the auxiliary body 11 a light module 13.1 of an alignment means 13 is arranged. This can preferably be extendable through an opening in a bore of the auxiliary body 11 such that the assembly of the auxiliary device 10 is cost efficient. Further, besides the alignment means 13 a switch element 17 is arranged, which is configured to switch between an activated I and an inactivated state II (shown here) of the alignment means 13. Thereby, the overall energy consumption of the alignment means 13 can be reduced and therewith the mobility of the auxiliary device 10 can be increased. Further, the safety during the alignment can be increased by the switch element 17 particularly such that potential hazards are reduced which can result from an activated of the alignment means 13. The switch element 17 is particularly usable within the scope of the embodiments of FIGS. 1 to 5 and 7 to 8.

FIG. 7 shows an auxiliary device 10 according to the invention in a further embodiment in a perspective view. Thereby, the auxiliary device 10 comprises an auxiliary body 11 which comprises handle means 15 at two opposing sides, wherein the handle means 15 are particularly configured as a groove respectively. Here, however, also other forms of handle means like for example an additional component are possible. Further, the auxiliary device 10 comprises an alignment means 13 which is in a determinable relation to a stop means 12. Thereby, the shown state is a deactivated state II of the alignment means 13, wherein this for example is switchable by a switch element 17 like for example is shown in FIG. 6 into an activated state I. The stop means 12 further comprises a blade 12.2 which extends from the auxiliary body 11 by contact areas 18 to contact the auxiliary device 10 on a winding sleeve 2 and thereby a stop plane 20 is provided. The contact areas 18 thereby configure a channel element 14 open at one side, wherein between the contact areas 18 a groove 18.2 is provided. Further, the auxiliary body 11 comprises a feature case 16.1. Thereby, the feature case 16.1 can be provided as an opening through which an energy unit 16 can be introduced into the auxiliary body 11. The energy unit 16 can preferably be a battery, particularly preferably a lithium-ion-battery via which energy can be provided for the alignment means 13 and/or an adjustability of the stop means 12. Thereby, for example a laser of the alignment means 13 can be usable independent from an externa energy source. This increases the mobility of the auxiliary device 10. Therewith, it can further be provided that with the auxiliary device 10 it can be a handheld unit which is operatable independent from the winder machine 4. Thereby, an auxiliary device 10 can be usable for example for multiple winder machines 4. Particularly, further the auxiliary body 11 can be from plastic, particularly polyamide. Thereby, the stop means 12 can be provided in one piece with the auxiliary body 11 or can be attached to the auxiliary body 11. With a configuration from multiple parts the stop means 12 can further be configured from stainless steel. Further, particularly the energy unit 16 and/or the feature case 16.1 can preferably be usable within the scope of the first embodiment and within the scope of the embodiments and FIGS. 4, 5, 6 and 8.

FIG. 8 shows a method according to the invention for adjusting a winding sleeve 2 with the reference 1 in a schematic drawing. Thereby, a placing 102 of an auxiliary device 10 at the winding sleeve 2 is provided such that a stop means 12 of the auxiliary device 10 can be brought into contact with the counter stop means 5 of the winding sleeve 2. Subsequently, a combined displacement 103 of the auxiliary device 10 in the winding sleeve 2 follows until an adjusting of the winding sleeve 2 and the reference 1 occurs via an alignment means 14 at the auxiliary device 10. Preferably, further a transferring 101 of the alignment means 13 from a deactivated state II into an activated state I can occur particularly previous to a placing 102 of the auxiliary device 10. Thereby, single steps of the method 100 can be repeated in any number and the whole method 100 is repeatable in order to for example adjust multiple winding sleeves. The method 100 therewith provides a flexible simple possibility to adjust a winding sleeve 2 with the reference 1 using an auxiliary device 10.

The previous description of the embodiments describes the present invention only within the scope of examples. Naturally, single features of the embodiments as far as technically meaningful can be freely combined with one another without leaving the scope of the present invention.

REFERENCE LIST

1 reference
2 winding sleeve
2.1 second winding sleeve
3 sleeve acceptance
3.1 second sleeve acceptance
4 winding machine
5 counter stop means
5.1 counter stop area
6 contact roller
7 product wrap
8 rotating device
10 auxiliary device
11 auxiliary body
11.1 first body part
11.2 second body part
12 stop means
12.1 stop area
12.2 blade
13 alignment means
13.1 light output means
13.2 location direction
14 channel element
14.1 channel axis
15 handle means
16 energy unit
16.1 feature case
17 switch element
18 support area
18.1 angle
18.2 groove
19 safety element
20 stop plane
I activated state
II deactivated state
100 method
101 transfer 13 from I to II
102 positioning of 10
103 displacing of 10 and 12

The invention claimed is:

1. An auxiliary device for aligning a winding sleeve, on a sleeve acceptance of a winder machine, with a reference, the device comprising:

an auxiliary body with a stop device, which is configured for contacting a counter stop device of a winding sleeve; and an alignment device for aligning the winding sleeve with the reference;

wherein the stop device and the alignment device comprise a determinable relation to one another, wherein a stop plane of the stop device contacts with a contact plane of the counter stop device, and wherein the stop plane is located between two end surfaces of the auxiliary body.

2. The auxiliary device of claim 1, wherein the alignment device involves at least an optic or acoustic alignment device.

3. The auxiliary device of claim 1, wherein the alignment device comprises a light output module.

4. The auxiliary device of claim 1, wherein the stop device is contactable at the counter stop device at least mainly in the contact plane and the alignment device is arranged such that the alignment device and the reference are at least mainly in a parallel or identical plane with the contact plane when the winding sleeve is aligned.

5. The auxiliary device of claim 1, wherein the auxiliary device is mobilly usable for aligning the winding sleeve.

6. The auxiliary device of claim 5, wherein a safety element is provided by which the auxiliary body is securable at the winding machine.

7. The auxiliary device of claim 1, wherein the auxiliary device comprises a channel element which is suitable for the acceptance of the winding sleeve.

8. The auxiliary device of claim 7, wherein the channel element comprises a channel axis and that at least one of the stop device or the alignment device is adjustable parallel to the channel axis.

9. The auxiliary device of claim 1, wherein the auxiliary body comprises a handle.

10. The auxiliary device of claim 9, wherein the handle comprises a recess in the auxiliary body.

11. The auxiliary device of claim 1, wherein the auxiliary device comprises an energy unit in order to operate the alignment device.

12. The auxiliary device of claim 1, wherein the auxiliary body comprises at least a first contact area which can be brought into contact with the winding sleeve.

13. The auxiliary device of claim 12, wherein the auxiliary body comprises at least a second contact area which is assembled in an angle to the first contact area, wherein the angle is smaller or equal to 150°.

14. The auxiliary device of claim 12, wherein the contact area is structured.

15. The auxiliary device of claim 1, wherein the stop device comprises a blade which particularly comprises a thickness smaller or equal to 1 mm.

16. The auxiliary device of claim 1, wherein the auxiliary device comprises a switch element by which the alignment device is transferable from an activated state to a deactivated state, wherein the alignment of the winding sleeve with the reference is possible via the auxiliary device when the alignment device is in the activated state, and wherein the alignment of the winding sleeve with the reference is impossible via the auxiliary device, when the alignment device is in the deactivated state.

17. The auxiliary device of claim 1, wherein the auxiliary body is configured from a plastic.

18. The auxiliary device of claim 1, wherein the switch element is arranged opposing a location direction of the alignment device at the auxiliary body.

19. A method for aligning a winding sleeve with a reference, the method comprising:

positioning the auxiliary device according to claim 1 at the winding sleeve such that a stop device of the auxiliary device is brought into contact with a counter stop of the winding sleeve, and performing combined displacement of the auxiliary device and the winding sleeve until an alignment of the winding sleeve with the reference occurs via an alignment device of the auxiliary device.

20. The method of claim 19, further comprising:

transferring of the alignment device from a deactivated state in an activated state.

* * * * *